US006318378B1

(12) United States Patent
Kennedy et al.

(10) Patent No.: US 6,318,378 B1
(45) Date of Patent: Nov. 20, 2001

(54) HAIR STYLING DEVICE

(76) Inventors: Melvin R. Kennedy, 825 Marbella La., Lantana, FL (US) 33642; Jose Longoria, 8325 SW. 108$^{th}$ St., Miami, FL (US) 33156

( * ) Notice: Subject to any disclaimer, the term of this patent is extended or adjusted under 35 U.S.C. 154(b) by 0 days.

(21) Appl. No.: 09/498,414

(22) Filed: Feb. 4, 2000

(51) Int. Cl.$^{7}$ ..... A45D 7/02; A45D 24/00
(52) U.S. Cl. ..... 132/212; 132/200
(58) Field of Search ..... 132/212, 200, 132/270, 273, 332; 219/143, 129

(56) References Cited

U.S. PATENT DOCUMENTS

| | | | | |
|---|---|---|---|---|
| Re. 15,909 | | 9/1924 | Pfrunder . | |
| 352,804 | | 11/1886 | Bowersox . | |
| 359,409 | | 3/1887 | Stone . | |
| D. 374,305 | | 10/1996 | Erickson et al. | D28/10 |
| 433,855 | | 8/1890 | Ellis . | |
| 830,137 | | 9/1906 | Diss . | |
| 1,398,444 | | 11/1921 | Pfrunder . | |
| 1,900,310 | | 3/1933 | Somerville . | |
| 1,992,281 | | 2/1935 | Arnold . | |
| 2,118,920 | * | 5/1938 | Gentile | 132/212 |
| 2,254,895 | | 9/1941 | Johnston, Jr. . | |
| 2,764,985 | | 10/1956 | Papish . | |
| 2,782,590 | | 2/1957 | Lowe . | |
| 2,785,689 | | 3/1957 | Trabish . | |
| 2,878,514 | | 3/1959 | Nichols et al. . | |
| 3,360,915 | | 1/1968 | Franzen . | |
| 3,421,406 | | 1/1969 | Mitchell et al. . | |
| 3,439,486 | | 4/1969 | Klein . | |
| 3,552,693 | | 1/1971 | Scherf . | |
| 3,834,146 | | 9/1974 | Nessler et al. | 57/58.54 |
| 4,038,996 | | 8/1977 | Eronini et al. . | |
| 4,130,122 | | 12/1978 | Kennedy | 132/212 |
| 4,262,479 | | 4/1981 | Lenorak | 57/58.54 |
| 4,307,737 | * | 12/1981 | Shipman | 132/212 |
| 4,369,690 | * | 1/1983 | Sapkus | 87/33 |
| 4,427,017 | | 1/1984 | Eronini | 132/212 |
| 4,580,585 | * | 4/1986 | Sapkus | 132/212 |
| 4,582,074 | | 4/1986 | Schwager et al. | 132/212 |
| 4,583,561 | * | 4/1986 | Larsson | 132/212 |
| 5,119,847 | * | 9/1992 | Powell et al. | 132/226 |
| 5,456,271 | * | 10/1995 | Legette | 132/212 |
| 5,497,795 | | 3/1996 | Hibbard . | |
| 5,575,297 | | 11/1996 | Hatchett et al. | 132/212 |
| 5,671,759 | * | 9/1997 | Chung et al. | 132/271 |
| 6,109,275 | | 8/2000 | Mendezmonsanto | 132/212 |

* cited by examiner

*Primary Examiner*—Gene Mancene
*Assistant Examiner*—Robyn Kieu Doan
(74) *Attorney, Agent, or Firm*—Ackerman Senterfitt

(57) ABSTRACT

A hair styling device for twirling locks of hair together including a main body, and at least two hair grabbers for respectively grabbing separate locks of hair. Each of the hair grabbers is connected to respective hair twisters, and each of the hair twisters rotates respective locks of hair to form twists of hair. The device further comprises a hair twist rotator body connected to each of the hair grabbers. The hair twist rotator body is connected to and rotatable relative to the main body. Rotation of the hair twist rotator body cables the twists of hair to form a cord of hair. The hair grabbers are substantially stationary relative to the hair twist rotator when the hair twist rotator rotates relative to the main body.

32 Claims, 5 Drawing Sheets

FIG. 6
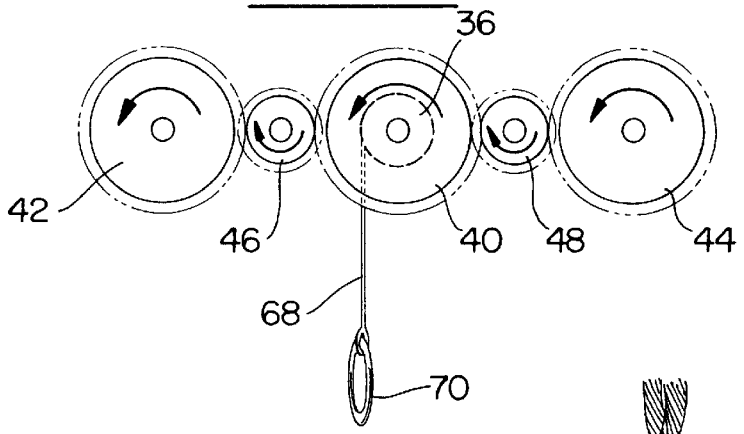
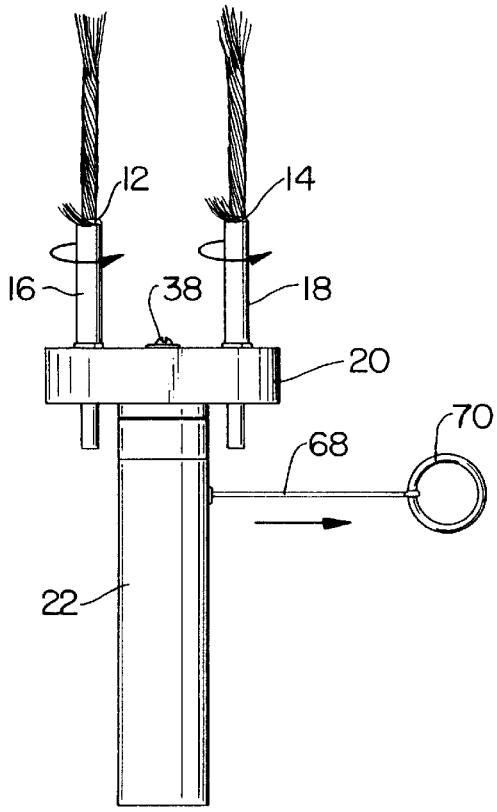
FIG. 5
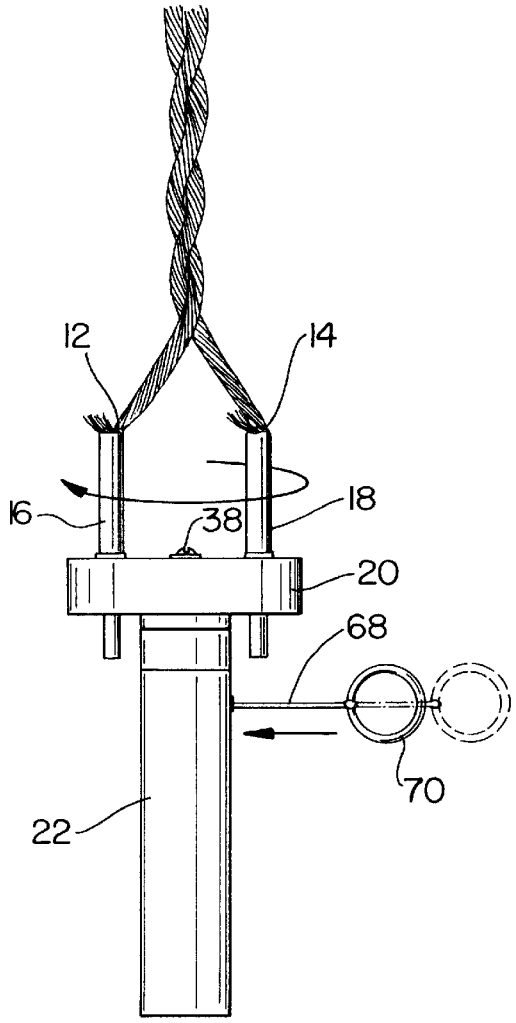
FIG. 7

HAIR STYLING DEVICE

CROSS-REFERENCE TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

1. Field of the Invention

This invention relates generally to devices for styling hair, and more particularly to an apparatus for twirling locks of hair together.

2. Description of Related Art

There are numerous methods of styling hair. One such method includes curling locks of hair. Devices for curling locks of hair are known in the art, including hand-operated hair curlers, as disclosed in U.S. Pat. No. 2,785,689 to Trabish and U.S. Pat. No. 2,118,920 to Gentile.

Another hair styling technique is braiding, which has traditionally been the process of interweaving three or more strands of hair in a diagonal overlapping pattern. The completed braid extends from a starting position near the scalp to the end of the hair, where it may be prevented from unraveling with a device such as a clip or a rubberband. Many attempts have been made to assist individuals in the braiding of hair. For example, U.S. Pat. No. 4,038,996 to Eronini, et al. discloses a portable hair braider which is motor operated and uses a plurality of foot members as hair parters for dividing hair over a predetermined width of the scalp. Hair grippers clamp the parted hair and rotate the strands, forming a braid. U.S. Pat. No. 5,497,795 to Hibbard discloses another hair braiding apparatus, in which a plurality of rings are utilized to interweave two strands of hair in between and through the plurality of rings to accomplish a braid.

While many devices are known in the prior art for styling hair, there is a need for an improved device for twisting locks of hair together without forming a braid. Accordingly, it is an object of the invention is to provide a hair styling device that assists with the twirling together of two or more locks of hair.

It is another object of the invention is to provide a hair styling device which will be suitable for use by hair stylists.

It is still a further object of the invention is to provide a hair styling device which will be suitable for use as a child's toy.

SUMMARY OF THE INVENTION

A hair styling device for twirling locks of hair together, according to an embodiment of the invention, includes a main body and at least two hair grabbers for respectively grabbing separate locks of hair. Each of the hair grabbers can be connected to respective hair twisters, and each of the hair twisters rotates respective locks of hair to form twists of hair. The device further comprises a hair twist rotator body connected to each of the hair grabbers. The hair twist rotator body can be connected to and rotatable relative to the main body. Rotation of the hair twist rotator body cables the twists of hair to form a cord of hair. The hair grabbers are substantially stationary relative to the hair twist rotator when the hair twist rotator rotates relative to the main body.

Each hair grabber can include a hook which is positionable between a release position and a grabbing position, and a retractor for moving the hook between the release position and the grabbing position. The retractor can be a spring. The device can also include a hair grabber body, and the hook can be recessed within a slot in the hair grabber body.

The hair twisters can synchronously rotate. The device can further include a shaft which is connected to each hair twister. Rotation of the shaft can impart motion to the hair twisters which, in turn, can cause the hair twisters to rotate the hair grabbers.

The device according to the invention can also include a main gear connected to the shaft and a grabber gear connected to each of the hair twisters. Rotation of the shaft can impart motion to the main gear, rotation of the main gear can impart motion to each grabber gear, and motion of each grabber gear can cause the hair twisters to rotate the hair grabbers. The device can also have a first clutch which prevents rotation of the main gear and the grabber gears while the hair twist rotator body rotates relative to the main body. Idler gears may be positioned between the main gear and the grabber gear.

The hair twist rotator body can hold the hair twisters. The device can also have an energy storage structure. Release of energy from the energy storage structure can rotate the hair twist rotator body relative to the main body. The energy storage structure can include an elastic loop having a first position coupled to the shaft. Additionally, the energy storage structure can have a reel mounted on the shaft, and a length of cord wound at least partially around the reel. In this arrangement, pulling the cord rotates the shaft, causing energy to be stored in the energy storage structure. Alternatively, the energy storage structure can be a motor. In either arrangement, the device can have a second clutch which prevents rotation of the hair twist rotator body while energy is being stored in the energy storage structure.

In another embodiment of the invention, a hair styling device for twirling locks of hair together includes a main body and hair grabbers for respectively grabbing separate locks of hair. Each of the hair grabbers can have a hair grabber body, a hook positionable between a release position and a grabbing position, and a retractor for moving the hook between the release position and the grabbing position. Each of the hair grabbers can be connected to respective hair twisters, and each hair twister can rotate the respective locks of hair to form twists of hair. The device further includes a shaft connected to each of the hair twisters. Rotation of the shaft imparts motion to the hair twisters, and this motion causes the hair twisters to rotate the hair grabbers. A hair twist rotator body is connected to each of the hair grabbers, and is connected to and rotatable relative to the main body. Rotation of the hair twist rotator body cables the twists of hair to form a cord of hair. The hair grabbers are substantially stationary relative to the hair twist rotator body when the hair twist rotator body rotates relative to the main body.

In this embodiment, the device can further include a main gear connected to the shaft and a grabber gear connected to each of the hair twisters, so that rotation of the shaft imparts motion to the main gear, rotation of the main gear imparts motion to each grabber gear, and motion of each grabber gear causes the hair twisters to rotate the grabbers. The device can also have a first clutch which prevents rotation of the main gear and the grabber gears while the hair twist rotator body rotates relative to the main body. The device can also include idler gears positioned between the main gear and each grabber gear.

A hair styling device for twirling locks of hair together, according to another embodiment of the invention, includes a main body and at least two hair grabbers for respectively grabbing separate locks of hair. Each of the hair grabbers has a hair grabber body, a hook positionable between a release position and a grabbing position, and a retractor for moving the hook between the release position and the grabbing position. In addition, each of the hair grabbers can be connected to respective hair twisters, and each hair twister rotates the respective locks of hair to form twists of hair. The device also has a shaft connected to each of the hair twisters. Rotation of the shaft imparts motion to the hair twisters, and this motion causes the hair twisters to rotate the hair grabbers. A hair twist rotator body holds the hair twisters, and is connected to and rotatable relative to the main body. Rotation of the hair twist rotator body cables the twists of hair to form a cord of hair. The device also has an energy storage structure. Release of energy from the energy storage structure rotates the hair twist rotator body relative to the main body. The hair grabbers are substantially stationary relative to the hair twist rotator body when the hair twist rotator body rotates relative to the main body.

According to another aspect of the invention, a hair styling device for twirling locks of hair together includes a main body, and at least two hair grabbers for respectively grabbing separate locks of hair. The hair grabbers are connected to respective hair twisters, and the hair twisters rotate respective locks of hair to form twists of hair. A shaft is connected to each of the hair twisters. Rotation of the shaft imparts motion to the hair twisters, and this motion causes the hair twisters to rotate the hair grabbers. A hair twist rotator body holds the hair twisters, and is connected to and rotatable relative to the main body. Rotation of the hair twist rotator body cables the twists of hair to form a cord of hair. The device can also include an energy storage structure. Release of energy from the energy storage structure rotates the hair twist rotator body relative to the main body. The hair grabbers are substantially stationary relative to the hair twist rotator body when the hair twist rotator body rotates relative to the main body.

According to this embodiment of the invention, the device can also include a main gear connected to the shaft and a grabber gear connected to each of the hair twisters. Rotation of the shaft imparts motion to the main gear, rotation of the main gear imparts motion to each grabber gear, and motion of each grabber gear causes the hair twisters to rotate the hair grabbers. The device can have a first clutch which prevents rotation of the main gear and the grabber gears while the hair twist rotator body rotates relative to the main body. Idler gears can be positioned between the main gear and each grabber gear.

The energy storage structure can be a reversible motor. Alternatively, the energy storage structure can include an elastic loop having a first portion coupled to the shaft, a reel mounted on the shaft, and a length of cord wound at least partially around the reel. Pulling the length of cord rotates the shaft, causing energy to be stored in the energy storage structure. In either arrangement, the device can also have a second clutch which prevents rotation of the hair twist rotator body while energy is being stored in the energy storage structure.

BRIEF DESCRIPTION OF THE DRAWINGS

There are presently shown in the drawings embodiments which are presently preferred, it being understood, however, that the invention is not limited to the precise arrangements and instrumentalities shown, wherein:

FIG. 5 is a perspective view showing one operating position of the invention.

FIG. 6 is a cross-sectional view taken along line 6—6 of FIG. 2, showing operation of hair twisting components according to the invention.

FIG. 7 is a perspective view showing a second operating position of the invention.

DETAILED DESCRIPTION OF THE PREFERRED EMBODIMENTS

Figure 1:
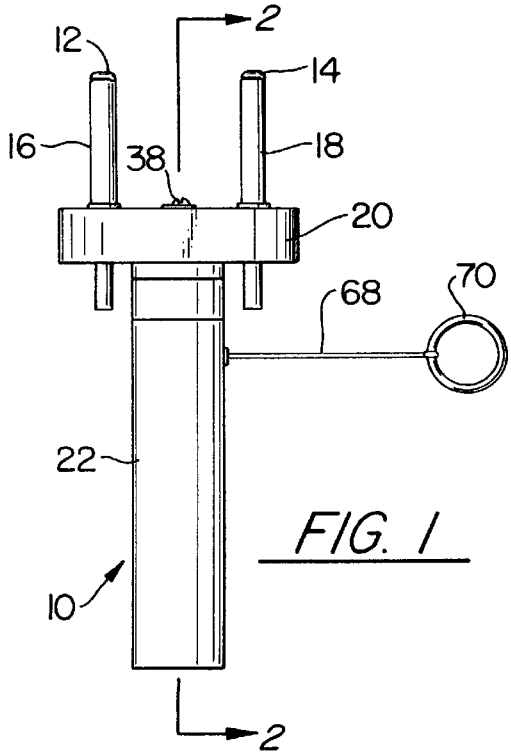
FIG. 1 is a perspective view of a hair styling device according to the invention.

FIG. 1 shows a hair styling device 10 according to the invention. The device 10 acts to twirl locks of hair together. The presently preferred device 10 includes two or more hair grabbers 12, 14 for grabbing separate locks of hair. Each of the hair grabbers 12, 14 can be connected to one or more hair twisters 16, 18. The hair twisters 16, 18 rotate locks of hair being held by hair grabbers 12, 14, forming separate twists of hair.

The hair twisters 16, 18 can be connected to a hair twist rotator body 20. The hair twist rotator body 20 can rotate the hair grabbers 12, 14 directly. Alternatively, the hair twist rotator body 20 can rotate the hair twisters 16, 18, and rotation of the hair twisters 16, 18 can cause the attached hair grabbers 12, 14 to rotate. In either arrangement, rotation of the hair twist rotator body 20 can cable the twists of hair to form a cord of hair.

The hair twist rotator body 20 can be connected to a main body 22, and is preferably rotatably connected to the main body 22. The hair grabbers 12, 14 preferably remain substantially stationary relative to the hair twist rotator body 20 when the hair twist rotator body 20 rotates relative to the main body 22. The main body 22 can be configured for gripping by the hand of a user of the device 10.

Figure 2:
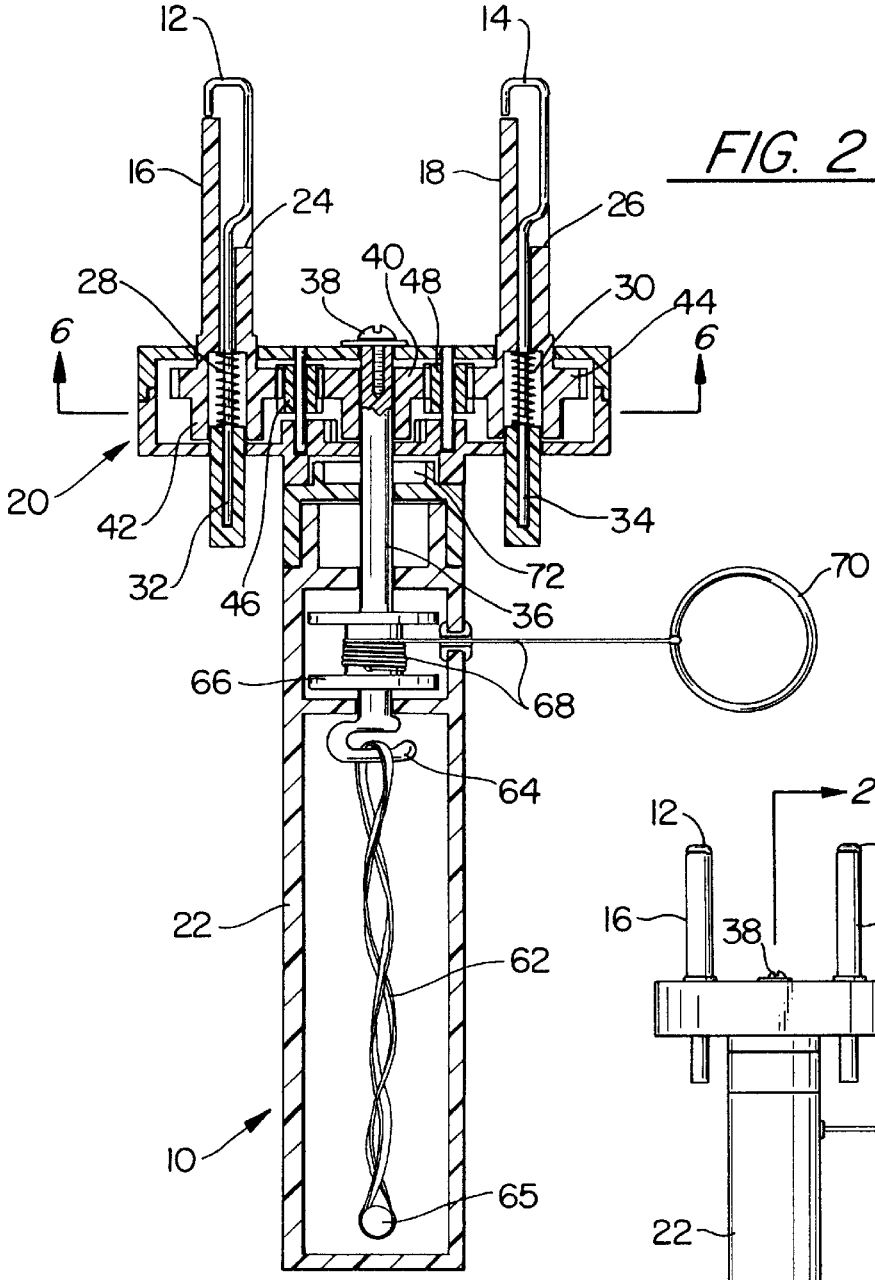
FIG. 2 is a cross-sectional view taken along line 2—2 of FIG. 1.

The hair grabbers 12, 14 can be any device suitable for grabbing hair, such as a clip, clasp, or fastener. As shown in FIG. 2, however, each of the hair grabbers 12, 14 is preferably a hook. Each hair grabber 12, 14 can reside in a slot 24, 26 within respective hair twisters 16, 18. The hair grabbers 12, 14 are positionable between a release position and a grabbing position. In FIG. 2, the hair grabbers are shown in the grabbing position.

Retractors 28, 30 can be used to move the hair grabbers 12, 14 between the release position and the grabbing position. The retractors 28, 30 can be any structure suitable for moving the hair grabbers 12, 14, but are preferably springs. Support rods 32, 34 which assist with the movement of the hair grabbers 12, 14 between the release and grabbing positions can be located proximate to the retractors 28, 30.

The hair twisters 16, 18 are preferably connected to a rotatable shaft 36. The shaft 36 can be mounted to the hair twist rotator body 20 with any suitable mounting structure 38, such as a screw, bolt, or pin. Rotation of the shaft 36 can impart motion to the hair twisters 16, 18. This movement of the hair twisters 16, 18 can cause the hair twisters 16, 18 to rotate the hair grabbers 12, 14.

A main gear 40 can be connected to the shaft 36 in any suitable manner, and is preferably mounted on the shaft 36. A grabber gear 42, 44 can be connected to each hair twister 16, 18. In the presently preferred embodiment, a grabber gear 42, 44 is mounted on each hair twister 16, 18. The main gear 40 and grabber gears 42, 44 can be operatively connected so that rotation of the shaft 36 imparts rotation to the main gear 40 and rotation of the main gear 40 imparts rotation to the grabber gears 42, 44. In this arrangement, motion of the grabber gears 42, 44 can cause the hair twisters 16, 18 to rotate the hair grabbers 12, 14.

Figure 3:
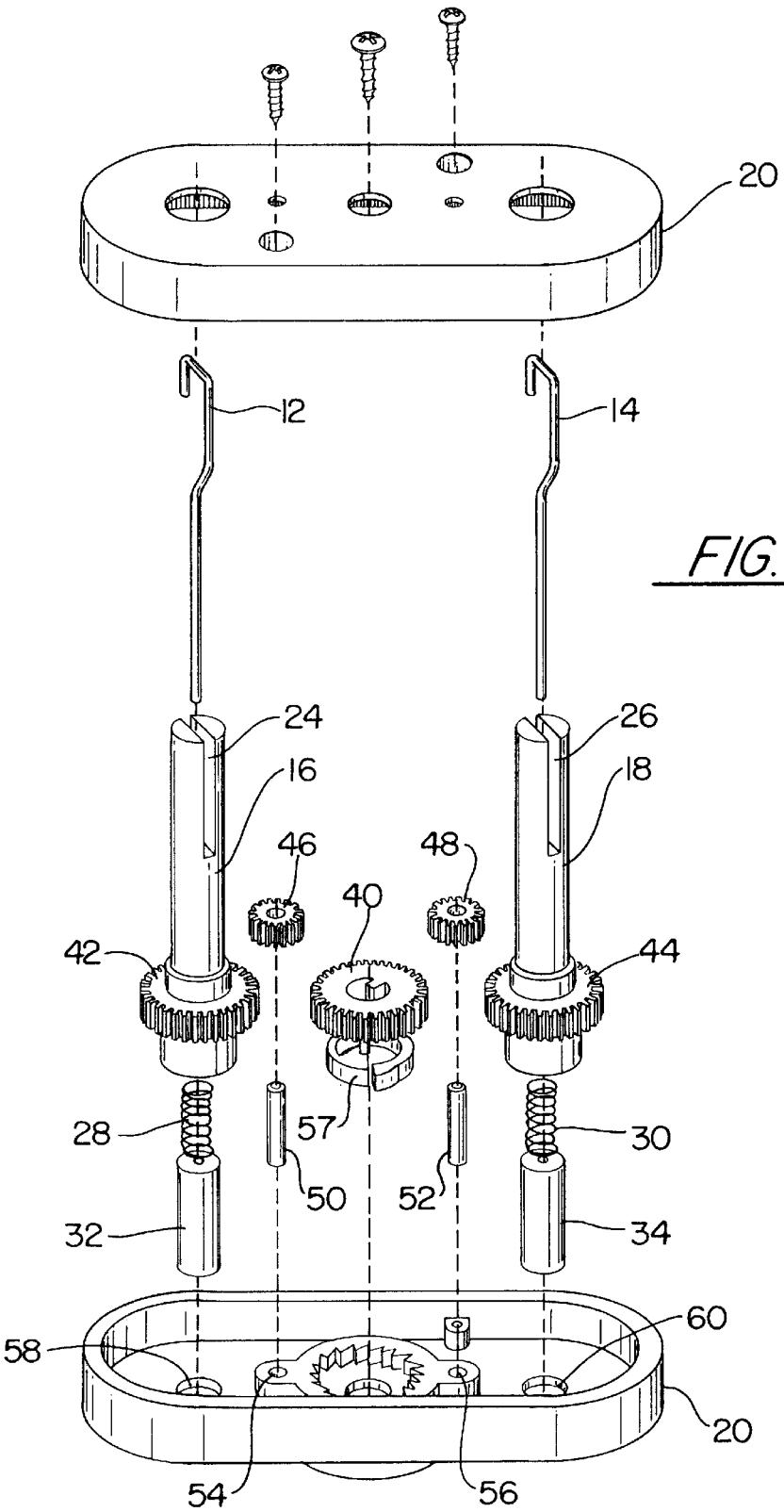
FIG. 3 is an exploded perspective view of hair grabbing, twisting, and rotating components of the invention.

Idler gears 46, 48 can be positioned between the main gear 40 and each of the grabber gears 42, 44. The idler gears 46, 48 can assist with the rotation of the main gear 40 and the grabber gears 42, 44 in a first direction while the idler gears 46, 48 rotate in a second direction. As shown in FIG. 3, each idler gear 46, 48 can be connected to an idler gear shaft 50, 52. A portion of the idler gear shafts 50, 52 can reside within recesses 54, 56 in an inner wall of the hair twist rotator body 20. However, the invention is not limited in that regard. Similarly, a portion of the support rods 32, 34 may also reside within recesses 58, 60 in the inner wall of the hair twist rotator body 20.

In the presently preferred embodiment, a gear clutch 57 is located proximate to the main gear 40, and may be connected to the lower portion of the main gear 40. The gear clutch 57 can prevent rotation of the main gear 40, the grabber gears 42, 44, and the idler gears 46, 48 while the hair twist rotator body 20 rotates relative to the main body 22.

Referring again to FIG. 2, the device 10 has energy storage structure which rotates the hair twist rotator body 20 relative to the main body 22. Any energy storage structure suitable for causing this rotation is acceptable. In a preferred embodiment, the energy storage structure includes an elastic loop 62, which can be twisted in order to store energy. The elastic loop 62 can have a first portion which is connected to a first coupling structure 64 on the shaft 36. The first coupling structure 64 is preferably located at one end of the shaft 36, however, the invention is not limited in that regard. The elastic loop 62 can also be attached to a second coupling structure 65. The second coupling structure 65 may be attached to an inner wall of the main body 22.

In the presently preferred embodiment, the energy storage structure also includes a reel 66 connected to the shaft 36. Preferably, the reel 66 is mounted on the shaft 36. A length of cord 68 can be wound at least partially around the reel 66. The cord 68 may be formed from any material suitable for acting as a draw string, including string or fishing wire. A pull ring 70 can be attached to the cord 68 to assist the user with extending the cord 68. In this arrangement, pulling the cord 68 rotates the shaft 36, causing the elastic loop 62 to twist. Twisting of the elastic loop 62 stores energy which can be released by allowing the cord 68 to retract to its initial position.

Figure 4:
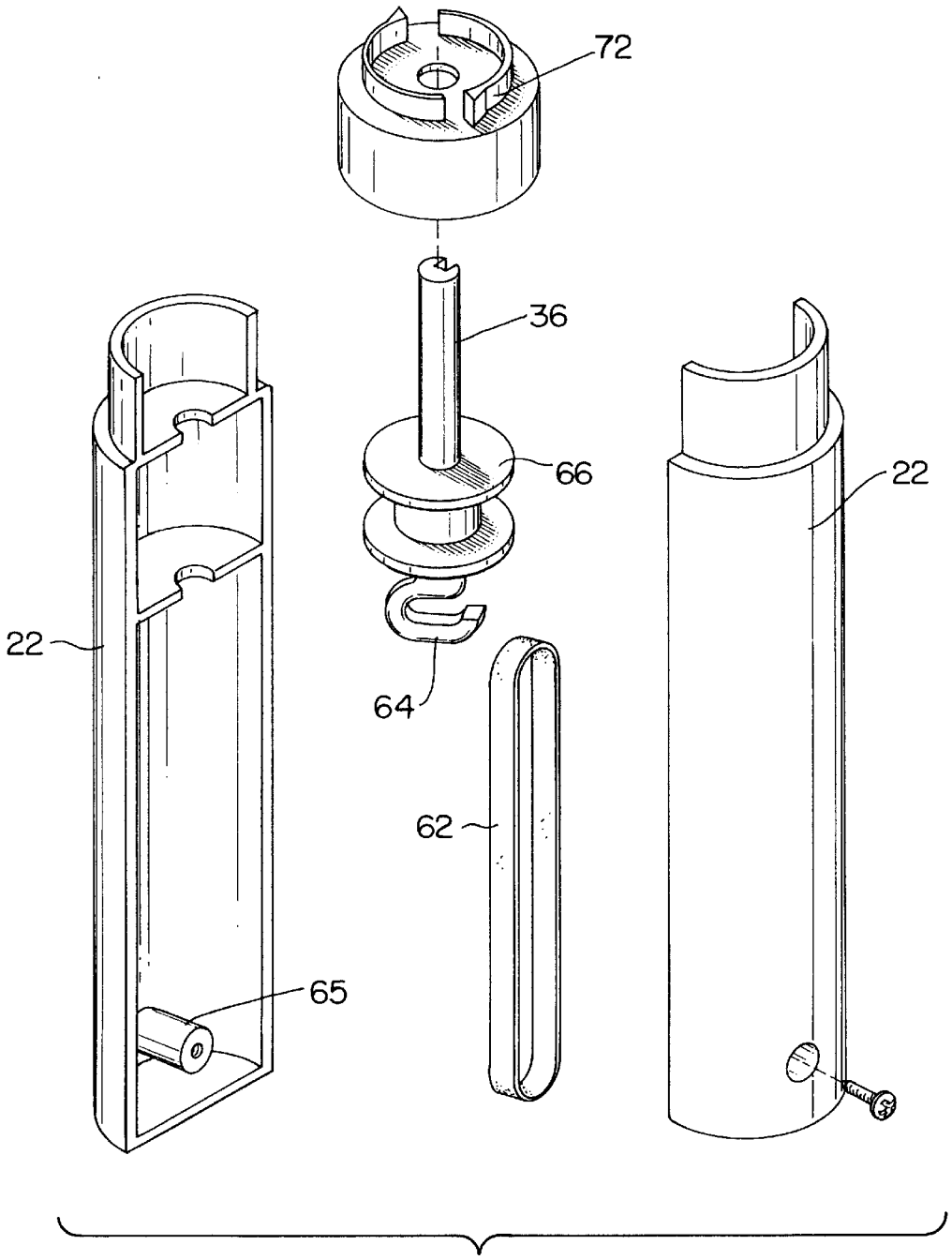
FIG. 4 is an exploded perspective view of hair rotating components of the invention.

As shown in FIGS. 1 and 4, the device 10 can have a hair twist rotator body clutch 72 which prevents rotation of the hair twist rotator body 20 while energy is being stored. For example, according to an embodiment of the invention, the hair twist rotator body clutch 72 can prevent the hair twist rotator body 20 from rotating while the cord 68 is being pulled and the elastic loop 62 is being twisted.

Referring now to FIGS. 5–7, the operation of the device 10 according to a preferred embodiment of the invention will be described. In FIG. 5, each hair grabber 12, 14 is grasping a lock of hair. In addition, the pull ring 70 has been pulled, causing the elastic loop 62 to become twisted, the cord 68 to be at least partially unwound from the reel 66, and the shaft 36 to rotate. As shown in FIG. 6, rotation of the shaft 36 imparts motion to the main gear 40, rotation of the main gear 40 imparts motion to each idler gear 46, 48, and rotation of each idler gear imparts motion to each grabber gear 42,44.

Referring again to FIG. 5, the motion of each grabber gear 42, 44 causes the hair twisters 16, 18 to rotate, imparting rotation to the hair grabbers 12, 14. Rotation of the hair grabbers 16, 18 forms separate twists of hair. The hair twist rotator body clutch 72 prevents the hair twist rotator body 20 from rotating while the hair grabbers 12, 14 and the hair twisters 16, 18 are rotating.

In FIG. 7, the pull ring 70 has been released, causing the elastic loop 62 to untwist and the cord 68 to wind more completely around the reel 66. The untwisting of the elastic loop 62 rotates the hair twist rotator body 20 relative to the main body 22. The gear clutch 57 prevents rotation of the main gear 40, the grabber gears 42, 44, and the idler gear 46, 48 while the hair twist rotator body 20 rotates relative to the main body 22. Rotation of the hair twist rotator body 20 cables the twists of hair to form a cord of hair.

Figure 8:
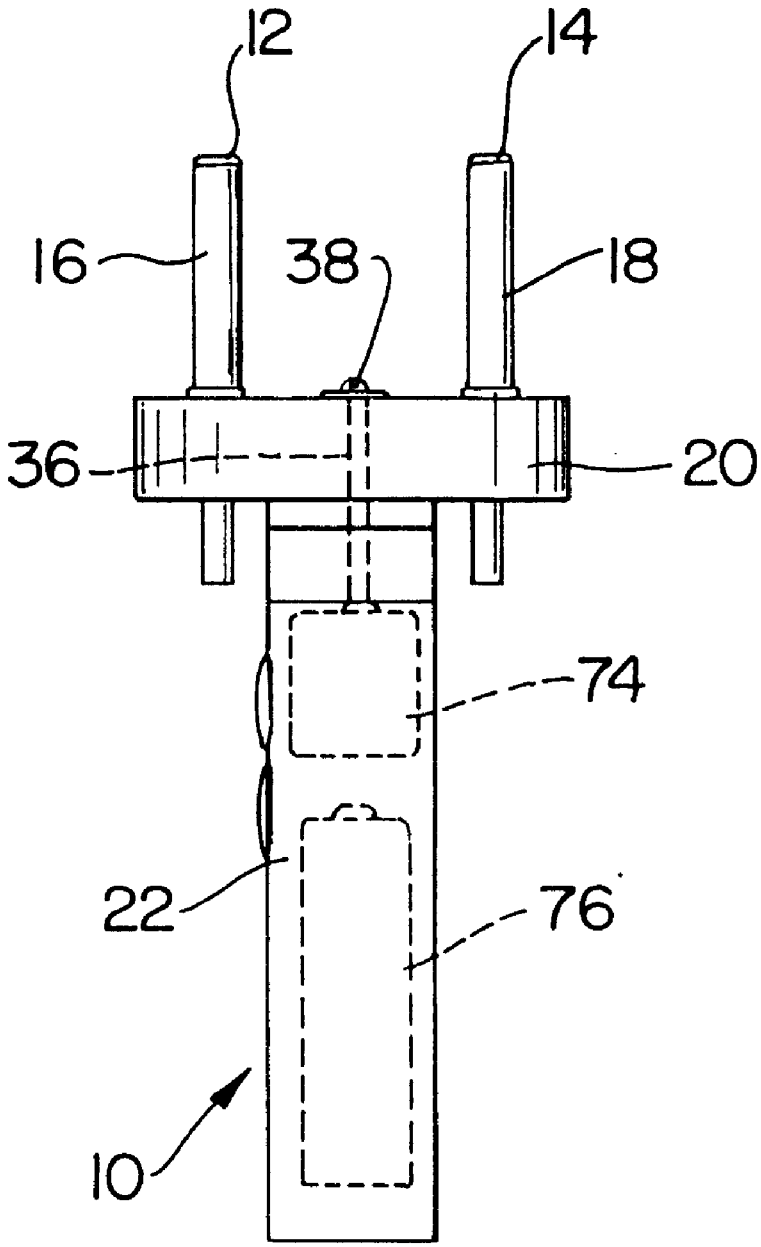
FIG. 8 is a perspective view of a hair styling device according to an alternate embodiment of the invention.

FIG. 8 shows an alternative embodiment of the invention, in which the energy storage structure can be any electrical motor 74, including a reversible motor. The motor 74 may be driven by any suitable power generator 76, including a battery or a cord connection to a 120 volt or a 240 volt electrical outlet.

It should be understood that the examples and embodiments described herein are for illustrative purposes only and that various modifications or changes in light thereof will be suggested to persons skilled in the art and are to be included within the spirit and purview of this application. The invention can take other specific forms without departing from the spirit or essential attributes thereof.

What is claimed is:

1. A hair styling device for twirling locks of hair together, comprising:

a main body;

at least two hair grabbers for respectively grabbing separate locks of hair, each of said at least two hair grabbers connected to respective hair twisters, each said hair twister rotating the respective locks of hair in a first direction to form twists of hair;

a hair twist rotator body connected to each of said at least two hair grabbers, said hair twist rotator body connected to and rotatable relative to said main body;

an energy storage structure, wherein said energy storage structure is a motor and wherein release of energy from said energy storage structure rotates said hair twist rotator body relative to said main body in a second direction opposite to said first direction, whereby rotation of said hair twist rotator body cables the twists of hair to form a cord of hair; and wherein said hair grabbers are substantially stationary relative to said hair twist rotator body when said hair twist rotator body rotates relative to said main body.

2. The device according to claim 1 having two hair grabbers.

3. The device according to claim 1, wherein each of said at least two hair grabbers comprises a hook positionable between a release position and a grabbing position.

4. The device according to claim 1, wherein each of said at least two hair grabbers comprises a hair grabber body and a hook positionable between a release position and a grabbing position, wherein said hook is recessed within a slot in said hair grabber body.

5. The device according to claim 1, wherein each of said at least two hair grabbers comprises a hook positionable between a release position and a grabbing position, and a retractor for moving the hook between the release position and the grabbing position.

6. The device according to claim 5, wherein said retractor is a spring.

7. The device according to claim 1, wherein said hair twisters synchronously rotate.

8. The device according to claim 1, further comprising a shaft connected to each of said hair twisters, wherein rotation of said shaft imparts motion to said hair twisters, whereby said motion causes said hair twisters to rotate said at least two hair grabbers.

9. The device according to claim 8, further comprising a main gear connected to said shaft and a grabber gear connected to each of said hair twisters, wherein rotation of said shaft imparts motion to said main gear, rotation of said main gear imparts motion to each said grabber gear, and motion of each said grabber gear causes said hair twisters to rotate said at least two hair grabbers.

10. The device according to claim 9, further comprising a first clutch which prevents rotation of said main gear and each said grabber gear while said hair twist rotator body rotates relative to said main body.

11. The device according to claim 9, further comprising idler gears positioned between said main gear and each said grabber gear.

12. The device according to claim 1, wherein said hair twist rotator body holds said hair twisters.

13. The device according to claim 1, further comprising a second clutch which prevents rotation of said hair twist rotator body while energy is being stored in said energy storage structure.

14. A hair styling device for twirling locks of hair together, comprising:

a main body;

at least two hair grabbers for respectively grabbing separate locks of hair;

each of said at least two hair grabbers connected to respective hair twisters, each said hair twister rotating the respective locks of hair to form twists of hair;

a shaft connected to each of said hair twisters, wherein rotation of said shaft in a first direction imparts motion to said hair twisters, whereby said motion causes said hair twisters to rotate said at least two hair grabbers;

a hair twist rotator body connected to each of said at least two hair grabbers, said hair twist rotator body connected to and rotatable relative to said main body in a second direction opposite to said first direction;

an energy storage structure, wherein said energy storage structure is an elastic loop having a first portion coupled to said shaft, wherein release of energy from said energy storage structure rotates said hair twist rotator body in said second direction relative to said main body to cable the twists of hair to form a cord of hair; and wherein said hair grabbers are substantially stationary relative to said hair twist rotator body when said hair twist rotator body rotates relative to said main body.

15. The device according to claim 14 further comprising a reel mounted on said shaft, and a length of cord wound at least partially around said reel, wherein pulling said cord rotates said shaft, whereby energy is stored in said energy storage structure.

16. The device according to claim 15, further comprising a main gear connected to said shaft and a grabber gear connected to each of said hair twisters, wherein rotation of said shaft imparts motion to said main gear, rotation of said main gear imparts motion to each said grabber gear, and motion of each said grabber gear causes said hair twisters to rotate said at least two hair grabbers.

17. The device according to claim 16, further comprising a first clutch which prevents rotation of said main gear and each said grabber gear while said hair twist rotator body rotates relative to said main body.

18. The device according to claim 16, further comprising idler gears positioned between said main gear and each said grabber gear.

19. A hair styling device for twirling locks of hair together, comprising:

a main body;

at least two hair grabbers for respectively grabbing separate locks of hair, each of said hair grabbers comprising a hair grabber body, a hook positionable between a release position and a grabbing position, and a retractor for moving the hook between the release position and the grabbing position;

each of said at least two hair grabbers connected to respective hair twisters, each said hair twister rotating the respective locks of hair to form twists of hair;

a shaft connected to each of said hair twisters, wherein rotation of said shaft imparts motion to said hair twisters, whereby said motion causes said hair twisters to rotate said at least two hair grabbers in a first direction;

a hair twist rotator body holding said hair twisters, said hair twist rotator body connected to and rotatable relative to said main body;

an energy storage structure, wherein said energy storage structure is a motor and wherein release of energy from said energy storage structure rotates said hair twist rotator body relative to said main body in a second direction opposite to said first direction, whereby rotation of said hair twist rotator body cables the twists of hair to form a cord of hair; and wherein said hair grabbers are substantially stationary relative to said hair twist rotator body when said hair twist rotator body rotates relative to said main body.

20. A hair styling device for twirling locks of hair together, comprising:

a main body;

at least two hair grabbers for respectively grabbing separate locks of hair, each of said at least two hair grabbers connected to respective hair twisters, each said hair twister rotating the respective locks of hair in a first direction to form twists of hair;

a shaft connected to each of said hair twisters, wherein rotation of said shaft imparts motion to said hair twisters, whereby said motion causes said hair twisters to rotate said at least two hair grabbers;

a hair twist rotator body holding said hair twisters, said hair twist rotator body connected to and rotatable relative to said main body;

an energy storage structure, wherein said energy storage structure is a motor and wherein release of energy from said energy storage structure rotates said hair twist rotator body relative to said main body in a second direction opposite to said first direction, whereby rotation of said hair twist rotator body cables the twists of hair to form a cord of hair; and wherein said hair grabbers are substantially stationary relative to said hair twist rotator body when said hair twist rotator body rotates relative to said main body.

21. The device according to claim 20, further comprising a main gear connected to said shaft and a grabber gear connected to each of said hair twisters, wherein rotation of said shaft imparts motion to said main gear, rotation of said main gear imparts motion to each said grabber gear, and motion of each said grabber gear causes said hair twisters to rotate said at least two hair grabbers.

22. The device according to claim 20, further comprising a first clutch which limits rotation of said main gear and each said grabber gear to said first direction.

23. The device according to claim 20, further comprising idler gears positioned between said main gear and each said grabber gear.

24. The device according to claim 20, wherein said motor is a reversible motor.

25. The device according to claim 20, further comprising a second clutch which prevents rotation of said hair twist rotator body while energy is being stored in said energy storage structure.

26. The device according to claim 1, wherein said motor is a reversible motor, said motor being capable of rotating said hair twisters in said first direction, and reversing so as to rotate said hair rotator body in said second direction.

27. The device according to claim 14, wherein each of said at least two hair grabbers comprises a hook positionable between a release position and a grabbing position.

28. The device according to claim 14, wherein each of said at least two hair grabbers comprises a hair grabber body and a hook positionable between a release position and a grabbing position, wherein said hook is recessed within a slot in said hair grabber body.

29. The device according to claim 14, wherein each of said at least two hair grabbers comprises a hook positionable between a release position and a grabbing position, and a retractor for moving the hook between the release position and the grabbing position.

30. The device according to claim 29, wherein said retractor is a spring.

31. The device according to claim 14, wherein said hair twisters synchronously rotate.

32. The device according to claim 14, further comprising a second clutch which prevents rotation of said hair twist rotator body while energy is being stored in said energy storage structure.

* * * * *